United States Patent [19]

Lund

[11] 4,238,082

[45] Dec. 9, 1980

[54] METHOD AND APPARATUS FOR SLITTING AND REWINDING WEB MATERIALS

[76] Inventor: Morten A. Lund, 148 Calle Maribel, San Marcos, Calif. 92069

[21] Appl. No.: 66,500

[22] Filed: Aug. 14, 1979

[51] Int. Cl.[3] ..... B65H 35/02

[52] U.S. Cl. ..... 242/56.2; 242/56.4; 242/56.7

[58] Field of Search ..... 242/56.2, 56.3, 56.4, 242/56.5, 56.7, 56.9

[56] References Cited

U.S. PATENT DOCUMENTS

| | | | |
|---|---|---|---|
| 2,399,155 | 4/1946 | Reed | 242/56.7 X |
| 2,698,359 | 12/1954 | Roberts | 242/56.4 X |
| 3,156,426 | 11/1964 | Brock | 242/56.2 |

*Primary Examiner*—Edward J. McCarthy
*Attorney, Agent, or Firm*—Brown & Martin

[57] ABSTRACT

In the disclosed apparatus, a web of material is fed from a supply roll, around a plurality of idler rollers, and past a series of blades which slit the web into a plurality of strips. Adjacent strips are rewound about corresponding product cores on different ones of a pair of takeup rollers in alternating fashion. Controls are provided for independently varying the amount of current supplied to first and second electric motors which drive the takeup rollers and supply roll respectively. The amount of slippage of the product cores relative to the takeup rollers can be adjusted by a clutch mechanism. According to the disclosed method, the takeup rollers are first brought up to full operating speed. The speed of the supply roll is gradually increased to feed the web to the product cores so that they rotate at approximately eighty percent of the speed of the takeup rollers throughout the rewinding operation. Product rolls with uniformly aligned edges and without high spots or material distortion are produced.

1 Claim, 6 Drawing Figures

METHOD AND APPARATUS FOR SLITTING AND REWINDING WEB MATERIALS

BACKGROUND OF THE INVENTION

The present invention relates to a method and apparatus for forming a web of material into a plurality of individual rolls. More particularly, the present invention relates to such a method and apparatus which insures that lightweight stretchable web materials are evenly wound into precise rolls with a minimum amount of material distortion.

Relatively thin sheet materials such as film, foil, paper, laminate and cloth are typically manufactured in the form of wide, long webs, which may measure, for example, six feet in width by one thousand feet in length. Each web is usually wound about an elongate cylindrical supply core for transport and storage. The manufacture of consumer products from such webs, for example rolls of adhesive tape, usually involves the use of an apparatus known as a slitter-rewinder. Examples of this type of apparatus are currently manufactured by Voorwood Company, 2350 Barney Street, Anderson, Calif. 96007 and Arrow Converting Equipment, Inc., Law Drive, Fairfield, N.J. 07006.

Known slitter-rewinder apparatus typically include an upright frame which supports a pair of powered takeup rollers and a supply roller or chuck for rotatably supporting the supply core and supply roll. During the rewinding operation, the web is guided by idler rollers from around the supply core past a series of slitting blades. The resulting strips of web material are rewound about a plurality of corresponding product cores on opposite ones of the takeup rollers in alternating fashion to give the necessary clearance between adjacent product rolls during their formation.

Heretofore, every slitter-rewinder apparatus known to me has utilized the powered takeup rollers for pulling the web material from around the supply core. This latter core has not been directly powered but has been rotated only through the pulling action supplied by the takeup rollers. An adjustable drag brake, usually of the disc type, has been utilized to prevent over-spinning of the supply roll. The disc brake has also been used to attempt to maintain the tension necessary for proper slitting and rewinding.

Known slitter-rewinder apparatus are used as follows. The product cores are slid over the takeup rollers with spacers splined to the takeup rollers positioned between adjacent product cores. Pneumatic means are utilized to compress the product cores endwise against the spacers with a predetermined amount of pressure. At the start of the rewinding operation, the supply core is initially fully braked to prevent rotation thereof. The takeup rollers are rotated within the stationary product cores which are held in position because of their attachment to the non-moving strips of the web material. The brake on the supply core is then gradually released manually, or automatically by means of a sensing device known as a dancer roll tension control. Eventually the friction between the product cores and the spacers is sufficient to cause the product cores to rotate and rewind the strips. The speed of rotation of the product cores increases as the brake is further released.

Heretofore with the slitter-rewinder apparatuses described above it has been difficult to precisely control the tension of the web portion extending between the supply and product cores to insure proper slitting and rewinding. This is especially true in the case of lightweight stretchable web materials such as acetate. Generally a relatively great amount of pulling force and resulting web tension are required to unwind the web from around the supply core. The amount of pulling force required increases as the diameter of the web around the supply core decreases and the resulting leverage is reduced. If the disc brake is released too quickly to compensate for the increased pulling forces required, then over-spinning occurs and the strips of web material weave laterally. The resulting product rolls are not uniformally edge aligned, but instead have a telescoping or other undesirable configuration. If the brake is released too slowly, then the web tension is too great and the material stretches. The resulting product rolls then have a slightly smaller intermediate diameter than edge diameter. When the strips are unrolled from these product rolls they are distorted and frequently have undulating side edges. This problem is particularly acute where the gauge or the thickness of the web varies across the width thereof. Regions called gauge bands, which extend lengthwise of the web and are of relatively greater thickness, will form high spots on the product roll when tightly rewound.

SUMMARY OF THE INVENTION

It is therefore an object of the present invention to provide an improved slitter-rewinder apparatus.

It is another object of the present invention to provide a slitter-rewinder apparatus in which the control of the web tension is improved to insure that lightweight, stretchable web materials are evenly wound into precise rolls with a minimum amount of material distortion.

It is a further object of the present invention to provide a slitter-rewinder apparatus in which the supply core is directly driven in order to feed the web to the powered takeup rollers.

It is still a further object of the present invention to provide a slitter-rewinder apparatus including separate motor means for enabling powered rotation of the supply and product cores and means for independently controlling the speeds of the respective motor means.

It is still a further object of the present invention to provide a slitter-rewinder apparatus of the aforementioned type in which the supply core is driven through intermeshing spur and worm gears to prevent over-spinning of the supply roll.

Yet another object of the present invention is to provide a slitter-rewinder apparatus which eliminates the need for a costly drag brake.

Finally, another object of the present invention is to provide an improved method of slitting and rewinding a web into a plurality of product rolls.

In the preferred embodiment of the slitter-rewinder apparatus disclosed herein, a pair of takeup rollers are rotatably supported on a frame which also supports a supply core chuck. The takeup rollers are rotatably driven by a first electric motor and the supply core chuck is rotatably driven by a second electric motor. The web is fed from around the supply core, around a plurality of idler rollers, and past a series of blades which slit the web into a plurality of strips. Adjacent strips are rewound about corresponding product cores on different ones of the takeup rollers in alternating fashion. The amount of slippage of the product cores relative to the takeup rollers can be adjusted by a clutch mechanism. The driving connection between the second electric motor and the chuck includes intermeshing spur and worm gears, which are adapted to prevent pulling forces exerted by the web portion extending between the supply and product cores from increasing the speed of rotation of the supply core. An electric control circuit is provided for independently varying the amount of electric current supplied to the first and second electric motors. According to the preferred method, the takeup rollers are first brought up to full operating speed. Then the speed of the supply core is gradually increased as that the product cores rotate at approximately eighty percent of the speed of the takeup rollers throughout the rewinding operation. Product rolls with uniformly aligned edges and without high spots are produced.

BRIEF DESCRIPTION OF THE DRAWINGS

Other objects and advantages of the present invention will become apparent from the following detailed description of a preferred embodiment thereof taken in conjunction with the accompanying drawings of which.

DESCRIPTION OF THE PREFERRED EMBODIMENT

Figure 1:
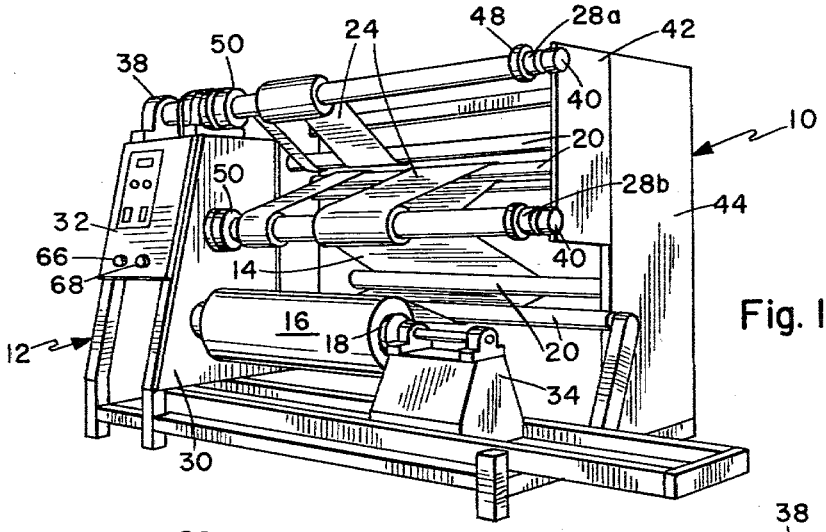
FIG. 1 is a perspective view of the slitter-rewinder apparatus.
Figure 2:
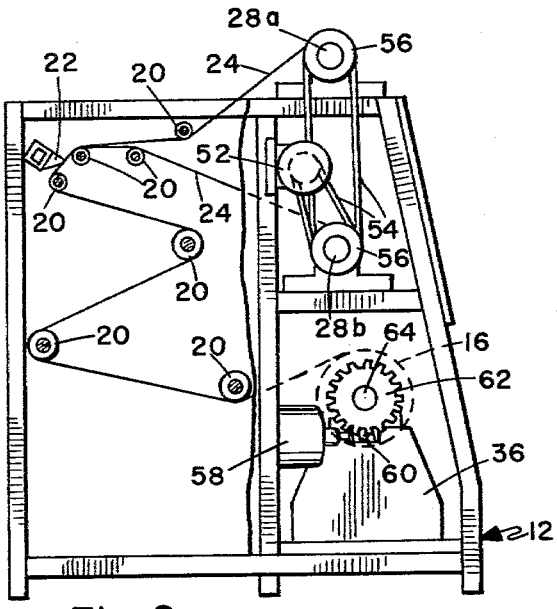
FIG. 2 is an enlarged end elevational view of the apparatus of FIG. 1 with portions broken away showing details of its drive mechanism and the manner in which the web of material is slit and rewound into product rolls.

Referring to FIG. 1, the illustrated embodiment 10 of the improved slitter-rewinder apparatus includes an upright frame 12 of interconnected horizontal and vertical steel box beams which are welded together to form a rigid supporting structure. The web of sheet material 14 is unwound from a relatively large roll 16 formed around an elongate cylindrical supply core 18, typically made of cardboard. As shown in FIGS. 1 and 2, the web 14 is threaded from the supply roll 16 around a plurality of idler rollers 20 which guide the web past knife means 22. The knife means typically comprise a series of spaced apart blades. The web is slit by the knife means into a plurality of strips 24. Adjacent strips are rewound about corresponding cardboard product cores 26 (FIG. 3), carried by different ones of a pair of takeup rollers 28*a* and 28*b* in alternating fashion as shown in FIG. 1. The slitter-rewinder apparatus has a motor housing 30 at one end of the frame 12. A control panel 32 is secured to the upper portion of the motor housing 30.

Chuck means are provided for quickly mounting the supply roll 16. A pneumatically operated tail stock assembly 34 (FIG. 1) and a fixed stock assembly 36 (FIG. 3) are provided for rotatably supporting the supply roll 16 at its opposite ends.

The takeup rollers are mounted so that their ends can be released to allow the product cores to be slid onto and off of the same. One set of ends of the takeup rollers 28*a* and 28*b* are journaled in bearings such as 38 (FIG. 1) rigidly secured to the motor housing 30. The other ends of the takeup rollers are journaled in bearings 40 secured to the forward edge of a first vertical plate 42. The rearward edge of the first vertical plate is hingedly attached to a second vertical plate 44. The first vertical plate 42 can be swung about a vertical axis to release the ends of the takeup rollers 28*a* and 28*b* from the bearings 40 to permit the product cores to be manually slid onto the rollers and finished product rolls to be slid off of the rollers.

Figure 3:
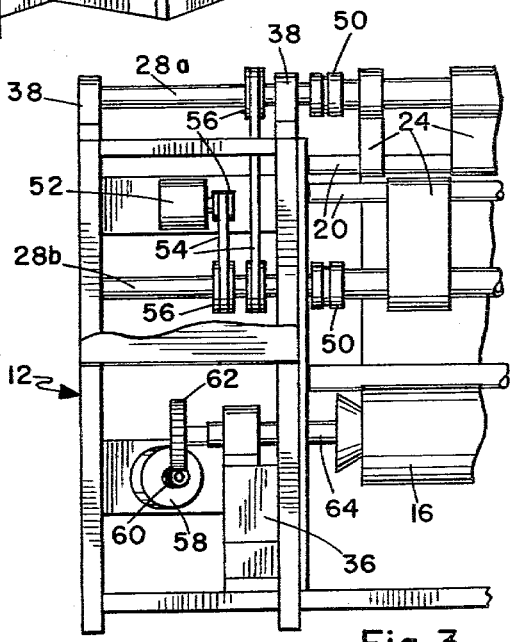
FIG. 3 is a fragmentary front elevational view of the apparatus of FIG. 1 showing further details of its drive mechanism.
Figure 4:
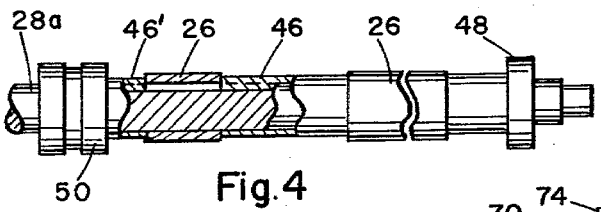
FIG. 4 is an enlarged view showing details of one of the takeup rollers of the apparatus of FIG. 1 and the alternating sequence of product cores and splined spacers which are clamped endwise on the takeup roller by a pneumatic clutch.

Referring to FIG. 4, the manner in which the product cores 26 are carried on the takeup rollers 28*a* and 28*b* is conventional for an apparatus of this type. The product cores have an inside diameter slightly larger than the outside diameter of the takeup rollers. They may be removably slid over the takeup rollers by an operator web setting up the apparatus for the slitting and rewinding operation. The takeup rollers include a plurality of cylindrical spacers 46 which are splined to the rollers (FIG. 3) and are positioned between adjacent product cores. The length of the spacers and the relative positions thereof along the length of the takeup rollers is predetermined by the size of the strips which are to be slit from the web 14. The spacers 46 are considered herein to form a part of the takeup rollers. As shown in FIG. 4, the alternating sequence of product cores 26 and spacers 46 are bound at one end by a removable cylindrical stop 48 and at the other end by a pneumatically operated clutch 50. The clutch is of conventional design and may be operated by air pressure to move axially against the spacer 46' to clamp the sequence of product cores and spacers endwise against the stop 48 when the first plate is locked in the position shown in FIG. 1. It will be understood that by increasing the pressure exerted by the clutch 48 against the sequence of spacers and product cores the amount of frictional engagement therebetween will be increased. As will later be explained, during the slitting and rewinding operation the product cores are initially held stationary and the takeup rollers rotate inside thereof. When the supply roll 16 is driven, the friction between the product cores and the spacers (the latter being considered part of the takeup rollers) is sufficient so that the product cores rotate and rewind the strips therearound. A cylindrical sleeve having a set screw and a spring between the sleeve and the spacer 46' may be substituted for the pneumatic clutch 50. The pressure on the sequence of product cores and spacers can be adjusted by changing the position of the sleeve.

First controllable motor means are provided for rotating the product cores 26 on the respective takeup rollers 28*a* and 28*b* together at various speeds. Each of the product cores is generally rotated at approximately the same speed at any given time, however the speed of rotation of the product cores as a group may be varied. Referring to FIG. 3, the first controllable motor means includes a first electric motor 52 and first coupler means for providing a driving connection between the motor and the takeup rollers 28*a* and 28*b*. The first coupler means may include a tandem arrangement of belts 54 and pulleys 56. Electric current can be supplied to the first electric motor 52 to enable simultaneous powered rotation of the takeup rollers at the same speed for rewinding the strips 24 around the product cores.

Second controllable motor means are provided for rotating the supply roll. Referring to FIGS. 2 and 3, the second controllable motor means includes a second electric motor 58. It further includes coupler means in the form of a worm gear 60 connected to the shaft of the motor 58 which intermeshes with a spur gear 52 connected to one end of the rotatable shaft 64 of the fixed stock 36. Electric current can be supplied to the second electric motor 58 to enable powered rotation of the roll 16. Preferably the worm and spur gears 60 and 62 are configured so that the roll 16 cannot be rotated as a result of the pulling forces exerted by the portion of the web being unwound therefrom. This may be achieved if the teeth of the spur gear 62 extend in an axial direction as indicated in FIG. 3 and if the motor 58 is mounted at an angle with respect to the shaft 64 so that the teeth of the worm gear and the teeth of the spur gear are parallel.

The design of the second coupling means provides a significant advantage in that it prevents over-spinning of the roll 16 which would reduce the tension of the portion of the web extending around the idler rollers below an acceptable level. Over-spinning tends to cause the strips to weave which results in product rolls having a telescoping or other undesirable configuration. The intermeshing spur and worm gears prevent pulling forces exerted by the takeup roller through the web from increasing the speed of rotation of the supply core. In the prior art apparatus described above it is possible for the pulling force exerted by the takeup rollers through the web to exceed the braking force of the disc brake in an amount sufficient to cause undesirable telescoping despite careful control of the brake.

Figure 6:
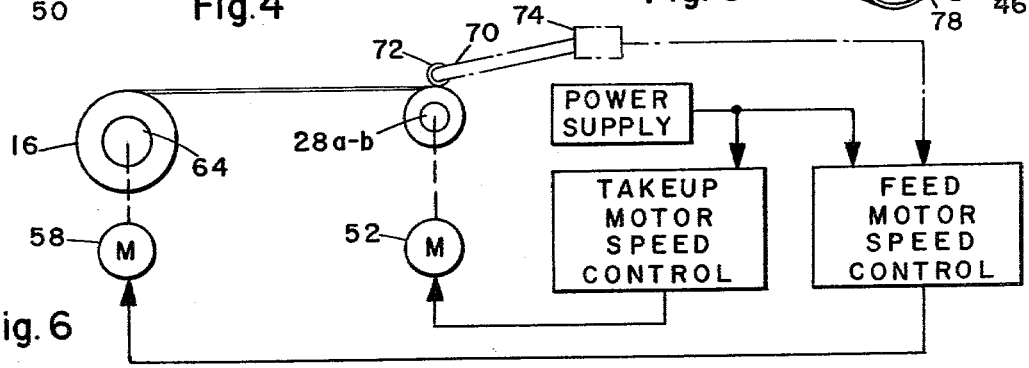
FIG. 6 is a schematic diagram of a control system for the apparatus of FIG. 1.

Finally, the illustrated embodiment of the slitter-rewinder apparatus includes means for independently controlling the first and second motor means to vary the speed of rotation of the cores. Referring to FIG. 6, electric circuit means may be provided for independently varying the amount of current supplied to the first and second electric motors. Electric current from a power supply is supplied through separate takeup and feed motor speed controls to the first and second electric motors 52 and 58 respectively. The speed controls may be of any conventional design which will depend upon the type of electric motors utilized and whether they operate on DC or AC current. For example, they may take the form of rheostats which may be manually adjusted by control knobs 66 and 68 (FIG. 1) mounted on the control panel 32.

If desired the control system illustrated in FIG. 6 may also include means for sensing the amount of the web that has been wound around the product cores and means responsive to the sensing means for automatically increasing the amount of current supplied to the second electric motor in a predetermined proportion to speed up the supply roll. For this purpose a conventional mechanism known as a dancer roll may be utilized. As later described, this mechanism is utilized to automatically maintain a desired rate of feed of the web. As shown in FIG. 6, the dancer mechanism may comprise a pivoting arm assembly 70 having a roller 72 which engages the outer surface of one of the product rolls. As the diameter of product roll increases the arm assembly 70 will pivot. A mechanical linkage then transmits this pivoting motion to operate a rheostat or potentiometer 74 to increase the amount of current supplied to the second electric motor 58 and increase the supply roll speed.

Having described the mechanical structure and electrical control system of the slitter-rewinder apparatus, the manner in which it may be operated to form a web of material into a plurality of individual rolls according to the method of the present invention may now be described. First the supply roll 16 is mounted between the stocks 34 and 36 as shown in FIG. 1. An alternating sequence of product cores and spacers are slid over the takeup rollers as previously described. The pneumatic clutches are operated to clamp the product cores and spacers together with a predetermined amount of pressure. The end of the web is manually threaded from the supply roll, about the idler rollers and past the knife means which slits the web into a plurality of strips. The ends of the strips are then affixed with adhesive tape or in some other suitable fashion to their corresponding product cores.

Next the takeup motor speed control is operated to rotate the takeup rollers at full operating speed, for example 200 rpm. At this point the supply roll is not powered. The product cores and the strips remain stationary and the takeup rollers spin within the product cores. Next the feed motor speed control is operated to start rotation of the supply roll. The frictional engagement between the product cores and the takeup rollers is sufficient so that the product cores start to rotate to rewind the strips therearound. The frictional engagement between the product cores and the takeup rollers is defined herein as the sum of the frictional engagement between the ends of the product cores and the spacers and between the inner walls of the product cores and the surfaces of the takeup rollers. The speed of rotation of the supply roll is increased until the product cores rotate at approximately seventy to ninety percent, and preferably eighty percent of the speed of the takeup rollers. This can be done by manually adjusting the feed motor speed control or automatically with the dancer apparatus.

As the supply roll diameter diminishes, the speed of rotation of the supply roll must be increased in order to maintain the previously mentioned relationship between the speed of the product cores and the speed of the takeup rollers. Sufficient tension for slitting the web is maintained and sufficient tension to prevent weaving is also maintained. However the tension is not so great that stretching of the web material occurs. After all of the web has been slit and rewound the rotation of the supply core and takeup rollers is terminated. The finished product rolls have uniformly aligned edges and do not have high spots. The strips later unwound the refrom are not distorted.

Figure 5:
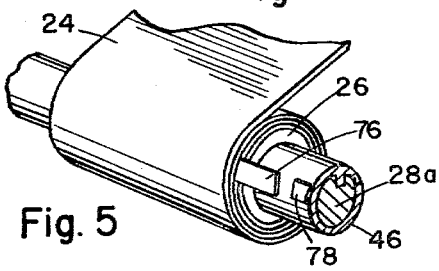
FIG. 5 is an enlarged fragmentary view of one of the takeup rollers of the apparatus of FIG. 1 illustrating a technique for estimating the speed of the product rolls relative to the takeup rollers during the rewinding operation.

The desired eighty percent relationship previously described can be roughly approximated by observing a marker such as a slip of paper 76 (FIG. 5) placed in one of the product rolls. During the rewinding operation, the relative motion or drift of the slip 76 with respect to a piece of tape 78 on an adjacent spacer 46 can be observed to estimate the relative speed difference.

The web material is fed to the product cores instead of being pulled from around the supply roll. Any pulling force that is exerted by the takeup rollers cannot result in over-spinning since the worm and spur gear drive limits the rotational speed of the supply roll to that determined by the amount of electric current supplied to the second electric motor. By adjusting the clutch mechanism associated with the takeup rollers the amount of frictional engagement between the product cores and the takeup rollers can be varied. This can also be utilized to control the tension of the web.

Having described preferred embodiments of the method and apparatus it will be apparent that the present invention permits of modification in both arrangement and detail. For example, the rotational speed of the product cores relative to the takeup rollers and the amount of slippage therebetween may vary depending upon the type of web material being slit and rewound. However, the present invention should be limited only in accordance with the scope of the following claims.

I claim:

1. A slitter-rewinder apparatus for forming a web of material into a plurality of individual rolls, the web being unwound from around an elongate supply core and slit into strips which are rewound about a plurality of individual product cores, the apparatus comprising:

a pair of takeup rollers each adapted slidably to receive a portion of the product cores thereabout;

chuck means for rotatably supporting the supply core;

frame means for supporting the pair of takeup rollers and the chuck means in spaced apart relationship including bearings for rotatably mounting the takeup rollers on the frame;

knife means for cutting the web into a plurality of strips after the web is unwound from about the supply core, adjacent strips being rewound about individual product cores on different ones of the pair of takeup rollers in alternating fashion;

a first electric motor for rotating the takeup rollers;

first coupler means for providing a driving connection between the first electric motor and the takeup rollers to enable simultaneous powered rotation of the rollers at the same speed for rewinding the strips around the produce cores;

clutch means for varying the amount of frictional engagement between the product cores and the respective takeup rollers they are on;

a second electric motor for rotating the supply core;

second coupler means for providing a driving connection between the second electric motor and the chuck means to enable powered rotation of the supply core for unwinding the web from therearound, including intermeshing spur and worm gears adapted to prevent pulling forces exerted by the takeup rollers through the web from increasing the speed of rotation of the supply core; and control means for independently varying the amount of electric current supplied to the first and second electric motors to vary the speeds of rotation of the cores, the control means including means for sensing the amount of the web that has been wound around the product cores, and means responsive to the sensing means for automatically increasing the amount of electric current supplied to the second electric motor.

* * * * *